US009263023B2

(12) United States Patent
Anazawa

(10) Patent No.: US 9,263,023 B2
(45) Date of Patent: Feb. 16, 2016

(54) AUDIO SPEAKER WITH SPATIALLY SELECTIVE SOUND CANCELLING

(71) Applicant: BlackBerry Limited, Waterloo (CA)

(72) Inventor: Isao Ginn Anazawa, Kitchener (CA)

(73) Assignee: BlackBerry Limited, Waterloo, Ontario (CA)

( * ) Notice: Subject to any disclaimer, the term of this patent is extended or adjusted under 35 U.S.C. 154(b) by 186 days.

(21) Appl. No.: 14/063,580

(22) Filed: Oct. 25, 2013

(65) Prior Publication Data

US 2015/0117657 A1 Apr. 30, 2015

(51) Int. Cl.
*G10K 11/175* (2006.01)
*H04R 3/12* (2006.01)

(52) U.S. Cl.
CPC ..... *G10K 11/175* (2013.01); *H04R 3/12* (2013.01); *H04R 2203/12* (2013.01); *H04R 2217/03* (2013.01); *H04R 2499/11* (2013.01); *H04R 2499/13* (2013.01)

(58) Field of Classification Search
None
See application file for complete search history.

(56) References Cited

U.S. PATENT DOCUMENTS

| | | | |
|---|---|---|---|
| 5,889,870 | A | 3/1999 | Norris |
| 6,052,336 | A | 4/2000 | Lowrey, III |
| 6,434,239 | B1 | 8/2002 | DeLuca |
| 6,778,672 | B2 | 8/2004 | Breed et al. |
| 7,835,529 | B2 | 11/2010 | Hernandez et al. |
| 2007/0025555 | A1 | 2/2007 | Gonai et al. |
| 2007/0211574 | A1 | 9/2007 | Croft, III |
| 2011/0103614 | A1 | 5/2011 | Cheung et al. |
| 2012/0076306 | A1 | 3/2012 | Aarts et al. |
| 2013/0034253 | A1 | 2/2013 | Nakayama |
| 2013/0089218 | A1 | 4/2013 | Kishinami et al. |
| 2013/0259254 | A1 | 10/2013 | Xiang et al. |

FOREIGN PATENT DOCUMENTS

| | | |
|---|---|---|
| JP | 2000036993 | 2/2000 |
| JP | 2005295411 | 4/2004 |
| WO | 9639754 | 12/1991 |

OTHER PUBLICATIONS

Machine Translation of JP 2000-036993, Koji, Feb. 2, 2000.*
Extended European Search Report dated Apr. 5, 2015 for European Application No. 14189505.2.
ReallyCoolToys.com., "Sound Beam Frequently Asked Questions," archived web page, Nov. 18, 2011. http://web.archive.org/web/20111118033325/http://reallycooltoys.com/pdf/soundb.pdf.
Gadsby, M., "Acoustic Beam-forming," Final year project final report, Jun. 2005, project supervisor Minyue Fu.

* cited by examiner

*Primary Examiner* — Paul Huber
(74) *Attorney, Agent, or Firm* — Jeffrey N. Giunta; Fleit Gibbons Gutman Bongini & Bianco P.L.

(57) ABSTRACT

A system and method for reproducing audio sound. Audio sound, based on an audio signal, is emitted within a space comprising an audio beamwidth. Modulated ultrasonic sound energy based on a modulated ultrasonic sound signal is emitted in an ultrasonic sound direction within an ultrasonic beamwidth that is less than and within the audio beamwidth. The modulated ultrasonic sound signal is generated such that the emitted modulated ultrasonic sound energy creates an audible cancellation sound with an amplitude substantially equal to an amplitude of the audio sound at a point within the ultrasonic beamwidth so as to combine with and cancel the audio sound at the point by being substantially out of phase with the audio sound along the ultrasonic sound direction.

15 Claims, 4 Drawing Sheets

AUDIO SPEAKER WITH SPATIALLY SELECTIVE SOUND CANCELLING

FIELD OF THE DISCLOSURE

The present disclosure generally relates to audio reproduction equipment, and more particularly to audio reproduction equipment that projects audio with selected spatial gaps in coverage.

BACKGROUND

Audio reproduction systems generally include a loudspeaker that emits audio sounds over a wide angle, or provide headsets or similar devices for more private listening. Audio reproduction systems with a loudspeaker allow many people in an area in front of the speaker to hear the reproduced audio sounds. The physics of loudspeakers limit the directionality that can be achieved, thereby causing loudspeakers to generally emit audio sounds over a large area that can be heard by everyone in that area. An alternative to a loudspeaker that broadcasts sounds over a wide area is for one or a few people to wear a headset such that only the people wearing a headset can hear the audio sound. Using headsets is often inconvenient because each individual is required to wear a headset to hear the audio. Such headsets further often require an electrical connection to the sound source to receive the audio, which adds expense to the system and sometimes inconvenience in their use. Applications that would beneficially use an audio reproduction systems that allow most people in an area to hear emitted audio but precludes one or a few people in that area from hearing that audio are difficult to implement with headsets since most people would require headsets and new arrivals are required to obtain and wear such headsets.

The usefulness of audio reproduction equipment in some applications is able to be enhanced by emitting audio sound over a large area but allowing the emitted sound to be cancelled in selected portions of those areas.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

Figure 1:
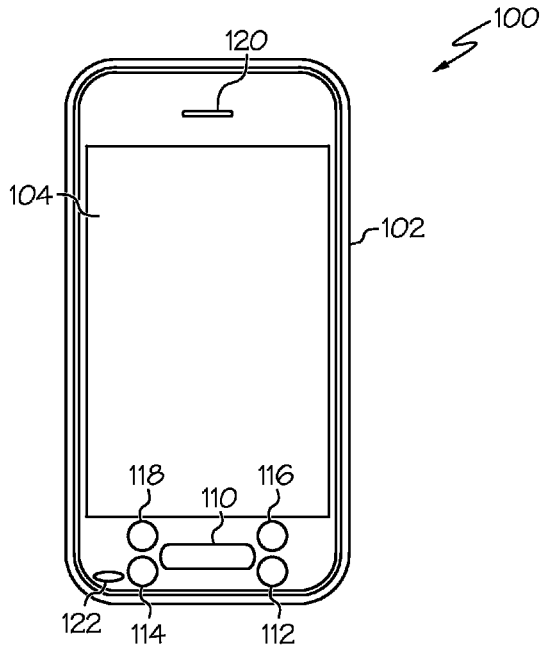
FIG. 1 illustrates a portable electronic device with audio sound reproduction system, according to an example.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically. The term "configured to" describes hardware, software or a combination of hardware and software that is adapted to, set up, arranged, built, composed, constructed, designed or that has any combination of these characteristics to carry out a given function. The term "adapted to" describes hardware, software or a combination of hardware and software that is capable of, able to accommodate, to make, or that is suitable to carry out a given function. In the following discussion, "handheld" is used to describe items, such as "handheld devices," that are sized, designed and otherwise configured to be carried and operated while being held in a human hand or hands.

The below described systems and methods provide an audio reproduction technique that emits an audio sound in the audible frequency range through a conventional speaker with a broad beamwidth, and also emits an audible cancellation sound in a narrow beamwidth that is within the broad beamwidth in order to cancel the audio sound within that narrow beamwidth. In one example, the narrow beamwidth is achieved by emitting modulated ultrasonic sound energy by a narrow beamwidth ultrasonic transducer. As is understood by practitioners of ordinary skill in the relevant arts, properly modulated ultrasonic sound energy is able to cause a listener in its path to hear audible sound. In general, the narrow beamwidth into which the modulated ultrasonic sound energy is emitted is within the broad beamwidth into which the audio sound is emitted, thereby creating a "hole" in the emitted audio sound in which a person will not hear the emitted audio sound.

The audio reproduction systems and methods described below are able to be beneficially used in several applications. In many examples, these systems and methods emit an audio sounds into space over a broad beamwidth and operate to cancel that audio sound at one or more particular locations in that space. The operation of these systems and methods are able to be applied in audio sound reproduction systems used for personal communications systems that are used in an office environment, in public spaces such as public transportation or transit centers, in crowded areas such as within a crowd of news reports, stock traders, and the like, or in naturally noisy environments such as a construction site. In such examples, an intended listener is able to hear audio sound that is emitted with high quality by a conventional audio sound transducer such as a speaker, while others in his or her vicinity will not hear the audio sound due to the directed audio sound cancellation operations described below.

In one example, the below described audio sound reproduction systems and methods are able to be used in a multiple player game environment. In an example of such an environment, several persons playing the same game are located near one another, and it is desired to have some audio sounds be heard by only one or more of the players, but those audio sounds are not to be heard by the other players. The below described audio sound reproduction systems and methods are able to emit audio sound over a wide beamwidth and cancel that audio sound at the particular locations of other players that are standing nearby. The operation of these systems and methods allow the player that is intended to hear the sound as well as any other observers to the game to also hear the emitted audio sound, while the other players do not hear that sound.

In the present discussion, audio sound or energy is described as being emitted in a beamwidth. As is understood by practitioners of ordinary skill in the relevant arts, a sound transducer generally emits sound energy into an area that is defined by an angle between lines extending from the sound emitter. i.e., the lines are a boundary defined by the sound energy or waves. The term beamwidth as used herein refers to the angle between lines extending from the sound emitter that defines the area into which an appreciable amount of the sound energy produced by the sound transducer is emitted. In general, not all sound energy emitted by a transducer is necessarily emitted into only the area defined by the stated beamwidth of that sound transducer. A transducer is able to emit some sound energy into directions outside the generally defined beamwidth for that transducer. The distribution of sound energy across the beamwidth, i.e., at different angles from the transducer that are within the beamwidth, is also able to vary within the beamwidth of the sound transducer.

As is known to practitioners in the relevant art, emitted ultrasonic sound energy that consists of an ultrasonic carrier that is suitably modulated with human audible sound information is able to pass through the air and produce an audible sound that is able to be heard by a person in the path of the emitted modulated ultrasonic sound energy. Examples of obtaining human audible sounds through the emission of modulated ultrasonic sound energy are described in "Parametric array in air", Bennett, Mary Beth, The Journal of the Acoustical Society of America, March, 1975, and U.S. Pat. No. 4,823,908 "Directional Loudspeaker System" to Takana et al., Apr. 25, 1989. These references are hereby incorporated herein by reference.

In the following discussion, quantities or dimensions that are described as substantially equal behave as though they are, in fact, equal or the result of any inequality is negligible. For example, inconsequential differences will exist between any relevant observations, effects, other characteristics, or combinations of these, when the substantially equal quantities are exactly equal or substantially equal.

In one example, modulated ultrasonic sound energy is emitted from an actual or virtual point that is collocated or substantially close to a point that is center of emission for the audio sound. In the following discussion, modulated ultrasonic sound energy and audio sound are considered to be emitted from substantially close emitters when the difference in propagation times of these two sounds does not affect the interaction of these two sounds as perceived by the listener at the at least one location in space as compared to the interaction of those two sounds if, in fact, they were emitted from the same point. In other words, the physical relationship between these two points of emission is described as being substantially close when sound energy from these two points of emission combine in at least one point in space such that the combined energy is similar to the combination of two sound energy signals that are emitted from the same point.

In the following discussion, a location in space that is of interest for the combining of sounds is referred to as a conventional listening point. In this context, a conventional listening point is one or more locations, relative to audio transducers, at which a person listening to sound emitted by those transducers is usually located. The location of a conventional listening point for a particular device or circumstance is dependent upon various factors, such as the type of device in which the audio sound reproduction system is incorporated. For example, a portable device, such as a handheld device operating in a loudspeaker mode, may have a conventional listening position that is between 0.5 meters and one or a few meters away. A television receiver may have a conventional listening position that extends between one meter and 5 meters. These conventional listening points are generally located at these distances from the device and across the wide beamwidth of an audio transducer.

A modulated ultrasonic sound signal is generated in one example that defines the modulated ultrasonic sound energy that is to be emitted. The modulated ultrasonic sound signal is received by one or more ultrasonic sound transducers and based on the received signal, those ultrasonic sound transducers produce the modulated ultrasonic sound energy. In one example, the generated modulated ultrasonic sound signal results in an emitted modulated ultrasonic sound energy that causes a listener in its path to hear audible sounds that are a replica of the audio sounds emitted by a speaker with a wider beamwidth, but the audio sounds resulting from the modulated ultrasonic sound energy are 180 degrees out-of-phase with the audio sounds emitted by the speaker as the two propagate away from their transducers. As such, the audio sounds resulting from the modulated ultrasonic sound energy combine with and cancel the audio sound emitted by the speaker within the narrow beamwidth of the modulated ultrasonic sound energy.

The modulated ultrasonic sound signal in some examples defines modulated ultrasonic sound energy that causes a listener at a conventional listening location to perceive audible sound with an amplitude substantially equal to the audio sound as well as being 180 degrees out-of-phase so as to create an audible cancellation sound that cancels out the audio heard by the listener at a particular conventional listening location. As is understood by practitioners of ordinary skill in the relevant arts, ultrasonic sound energy propagating in the air attenuates faster than human audible sounds. The amount of attenuation experienced by the ultrasonic sound energy is dependent upon the frequency of the ultrasonic sound energy, with higher frequencies attenuating faster than lower frequencies. Selection of a center frequency of the emitted modulated ultrasonic sound energy is therefore able to allow selection of the amount of attenuation with distance to which the modulated ultrasonic sound energy will be attenuated. In order to accommodate the difference in sound attenuation, the amplitude of the generated modulated ultrasonic sound signal in one example is increased according to an expected amount of attenuation to which the sound will be subjected to as it travels to the conventional listening point. In further examples, a distance is determined, such as by wireless distance measuring equipment, between the ultrasonic sound transducer emitting the modulated ultrasonic sound energy and an object receiving the emitted modulated ultrasonic sound energy and the amplitude of the modulated ultrasonic sound signal is increased based upon that determined distance.

FIG. 1 illustrates a portable electronic device with an audio sound reproduction system 100, according to an example. The portable electronic device with an audio sound reproduction system 100 depicts a handheld cellular phone 102 that includes a conventional earpiece speaker 120 and a microphone 122 that are used when the handheld cellular phone 102 is held to a user's face. As is well known, a handheld cellular phone 102 is able to be used for bi-directional wireless audio telephone calls and for a variety of other functions. The handheld cellular phone 102 in this example has a display 104 that is used to present images to a user (not shown) for a variety of uses.

The illustrated handheld cellular phone 102 further has an audio loudspeaker 110 that is able to emit audio sound at a higher level so as to allow the audio sound to be heard at a distance from the handheld cellular phone 102 when the device is removed from the user's ear. In general, a user desires to hear sounds produced by the audio loudspeaker 110 when the user is relatively close to the handheld cellular phone 102, such as when the user is between 0.5 and one meter from the device, or perhaps up to two meters or more in some examples. In an example, a user viewing images or moving pictures on the display 104 may be holding the handheld cellular phone 102 within an arm's length from his or her head.

The sound level produced by the loudspeaker 110 may be uncomfortable if the loudspeaker were held to the user's ear. As such, the loudspeaker 110 is generally separate and removed from the earpiece speaker 120 to avoid inadvertently placing the loudspeaker 110 to the user's ear. In various examples, a loudspeaker such as the illustrated loudspeaker 110 is able to be placed at any location on the handheld cellular phone 102, such as on the back or on an edge of the housing of the handheld cellular phone 102.

The illustrated handheld cellular phone 102 further includes a number of ultrasonic sound transducers that are mounted in proximity to the loudspeaker 110. A first ultrasonic sound transducer 112 and a second ultrasonic sound transducer 114 are mounted in a horizontal line below the loudspeaker 110. A third ultrasonic transducer 116 and a fourth ultrasonic transducer 118 are mounted in a horizontal line above the loudspeaker 110. As described in further detail below, the ultrasonic sound transducers emit modulated ultrasonic sound energy into a particular direction, referred to as an ultrasonic direction. In one example, the ultrasonic sound transducers are narrow beamwidth ultrasonic emitters that are each positioned to point in different directions. In a further example, the multiple ultrasonic sound transducers emit ultrasonic sound over a broader beamwidth and form a phased array to cause emitted modulated ultrasonic sound energy to propagate in a particular direction by controlling the propagation angle at which constructive interference occurs.

In the first example of four ultrasonic sound transducers that each emit ultrasonic energy within a narrow beamwidth that point into different angles relative to the front of the handheld cellular phone 102, a particular ultrasonic direction at which modulated ultrasonic sound energy propagates is able to be selected by selecting one of the multiple ultrasonic sound transducer that is to be driven by a modulated ultrasonic sound signal. In an example where The four ultrasonic sound transducers operate as a phased array of ultrasonic sound transducers to emit ultrasonic energy along a determined direction, each ultrasonic sound transducer is driven by a modulated ultrasonic signal that has a phase shift relative to the modulated ultrasonic signal driving the other ultrasonic sound transducers so as to cause the modulated ultrasonic sound energy emitted by the multiple ultrasonic sound transducers to constructively add in in the ultrasonic direction, and add less effectively at other angles relative to the front of the device.

Figure 2:
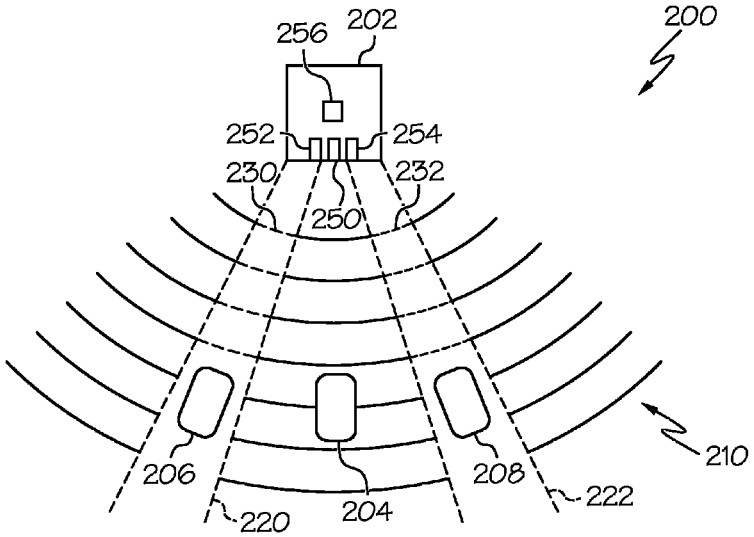
FIG. 2 illustrates a sound propagation diagram, according to an example.

FIG. 2 illustrates a sound propagation diagram 200, according to an example. A sound reproduction system 202 is depicted with an audio loudspeaker 250, a first ultrasonic sound transducer 252 and a second ultrasonic sound transducer 254. In the illustrated example, the first ultrasonic sound transducer 252 and the second ultrasonic sound transducer 254 are highly directional ultrasonic sound transducers that receive, for example, a modulated ultrasonic sound signal and emit, based on a modulated ultrasonic sound signal received by the transducer, modulated ultrasonic sound energy in a particular direction with a relatively narrow beamwidth. The first ultrasonic sound transducer 252 and the second ultrasonic sound transducer 254 in this example are mounted such that they emit their respective modulated ultrasonic sound energy in different directions, as is described below. In further examples, a phased array of ultrasonic transducers is able to be operated so as to similarly create two narrow beams of modulated ultrasonic sound energy.

The sound propagation diagram 200 depicts an audio sound 210 that is propagating from the loudspeaker 250. The audio sound 210 is a human audible pressure wave sound that is able to be heard by a person at a location in front of the audio sound reproduction system 202. The propagation pattern of human audible audio sounds from a loudspeaker, such as loudspeaker 250, generally propagates with a broad beamwidth from the loudspeaker 250. Although the sound level of the audio sound 210 may vary at different angles relative to the face of the loudspeaker 250, a listener is generally able to hear the sound emitted by the loudspeaker 250 over a broad range of angles relative to the face of the loudspeaker 250.

The loudspeaker 250 emits the audio sound 210 with an audio beamwidth that extends across the front of the sound reproduction system 202. The first ultrasonic sound transducer 252 is shown to emit modulated ultrasonic sound energy along a first ultrasonic sound path 220 that has a relatively narrow beamwidth in comparison to the beamwidth of the audio sound 210. The second ultrasonic sound transducer 254 is similarly shown to emit modulated ultrasonic sound energy along a second ultrasonic sound path 222 that also has a relatively narrow beamwidth in comparison to the beamwidth of the audio sound 210. The direction of the first ultrasonic sound path 220 relative to the front of the sound reproduction system 202 is referred to herein as a first ultrasonic direction, and the direction of the second ultrasonic sound path 222 is referred to as a second ultrasonic direction that is different than the first ultrasonic sound direction.

The sound propagation diagram 200 depicts three persons who are positioned within conventional listening positions for the sound reproduction system 202. A primary listener 204 is located in front of the sound reproduction system 202 and is intended to hear the audio sound 210. A first bystander 206 and a second bystander 208 are shown on either side of the primary listener 204. In the illustrated example, the sound reproduction system operates to preclude the first bystander 206 and the second bystander 208 from hearing the audio sound 210. In an example, these three persons are people playing a multiple player game where each person hears some of the audio, but parts of the audio are only heard by one person, such as the primary listener 204, and not heard by the other two.

In the illustrated example, the first ultrasonic transducer 252 and the second ultrasonic transducer 254 are driven by a modulated ultrasonic sound signal such that those transducers emit modulated ultrasonic sound energy that creates audible sounds that a human can hear, where those audible sounds are replicas of the audio sound 210 emitted by loudspeaker 250 except that the audio sound heard as a result of the emitted ultrasonic sound is 180 degrees out of phase with the audio sound 210. Because the first ultrasonic transducer 252 and the second ultrasonic transducer 254 are located substantially close to the loudspeaker 250, the modulated ultrasonic sound signal is able to be generated based upon known physical relationships between those components and does not require feedback of sound received at the position of the listener in order to to properly create the out-of-phase sound cancellation signal used to drive the ultrasonic transducers, the phase of the emitted sound is assumed to be substantially similar. In some examples, a phase shift to accommodate transducer arrangements is also able to be induced onto the audio that results from the modulated ultrasonic sound signal.

In the illustrated example, the first ultrasonic sound transducer 252 emits narrow beamwidth modulated ultrasonic sound energy along the first ultrasonic sound path 220 and the second ultrasonic sound transducer 254 emits narrow beamwidth ultrasonic energy along the second ultrasonic sound path 222. Because these ultrasonic transducers emit modulated ultrasonic sound energy that creates an out-of-phase human audio signal within their respective beamwidths, the audio sound 210 emitted by the loudspeaker 250 is effectively "cancelled" within those beamwidths. As is known by practitioners in the relevant arts, ultrasonic sound energy attenuates faster with respect to distance from the emitter than audible sound. The amount of attenuation with respect to distance increases with the frequency of the ultrasonic sound. In order to accommodate this increased rate of attenuation with distance, the modulated ultrasonic sound signal driving the ultrasonic transducers is adjusted to increase the amplitude of the audible sound created by the modulated ultrasonic sound energy in order to cause the audible sound heard by a listener at a conventional listening position to have a proper amplitude to cancel the audio sound 210 at that location and not be heard by the listener at that location. As is known by practitioners in the relevant arts, the amplitude of audible sounds created by modulated ultrasonic sound energy is able to be varied, e.g., increased, by varying the amount of modulation applied to the central ultrasonic carrier of the modulated ultrasonic sound energy, by increasing the intensity of the emitted ultrasonic sound energy, or by other suitable means.

In an example, the loudspeaker 250 is an example of an audio frequency sound transducer system that is configured to emit an audio sound within a space comprising an audio beamwidth, wherein the audio sound is based on an audio signal. The first ultrasonic sound transducer 252 and the second ultrasonic sound transducer 254 are an example of an ultrasonic sound transducer component configured to emit modulated ultrasonic sound energy in an ultrasonic sound direction within an ultrasonic beamwidth that is less than and within the audio beamwidth, wherein the modulated ultrasonic sound energy is based on a modulated ultrasonic sound signal. The loudspeaker and ultrasonic sound transducers depicted in these drawings are able to each have one or more speakers or transducers. An ultrasonic signal generator, that is within the sound reproduction system 202 in one example, is configured to generate the modulated ultrasonic sound signal, the ultrasonic signal generator configured to generate the modulated ultrasonic sound signal such that the modulated ultrasonic sound energy emitted by the ultrasonic sound transducer creates an audible cancellation sound with an amplitude substantially equal to an amplitude of the audio sound at a point within the ultrasonic beamwidth so as to combine with and cancel the audio sound at the point by being substantially out of phase with the audio sound along the ultrasonic sound direction.

In the illustrated example, a first close modulated ultrasonic sound energy field 230 is shown near the first ultrasonic sound transducer 252, and a second close modulated ultrasonic sound energy field 230 is shown near the second ultrasonic sound transducer 254. These close modulated ultrasonic sound energy fields create audible sound in those areas that is out-of-phase with the audio sound 210, but have a larger amplitude. Due to their larger amplitudes, the audio created by the close modulated ultrasonic sound energy fields are not fully cancelled by the audio signal 210 and can be heard in those locations. In general, a person is not located in the locations of those close ultrasonic sound energy fields and the perceivable sounds in those locations are acceptable.

The sound reproduction system 202 of FIG. 2 is shown to have an object detection component 256 that operates to determine the distance between the sound reproduction system 202 and object such as potential listeners. In the illustrated example, the object detection component 256 is able to operate to determine distances from the sound reproduction system 202 and the primary listener 204, the first bystander 206, and the second bystander 208. In further examples, the location of these persons relative to the face of the loudspeaker 250 is also able to be determined By determining the location of these persons, the sound reproduction system 202 is able to, for example, alter the ultrasonic sound directions of emitted modulated ultrasonic sound energy in order to direct the ultrasonic sound energy to the proper locations that are occupied by a listener or bystander. The location of persons that are is bystanders also enables more accurate determination of the amount of attenuation the modulated ultrasonic sound energy will experience before reaching that bystander, and thereby allow compensation of the generated modulated ultrasonic sound signal to increase the amplitude of the audio signal created by the modulated ultrasonic sound energy at the location of the bystander.

Figure 3:
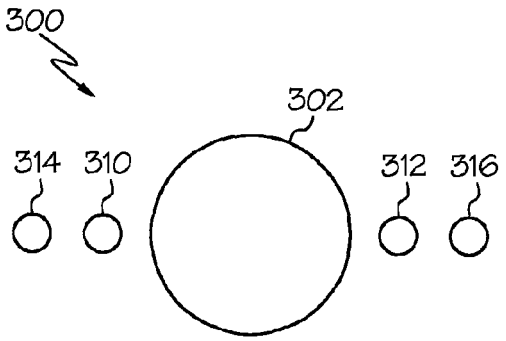
FIG. 3 illustrates a first ultrasonic sound transducer arrangement, according to an example.

FIG. 3 illustrates a first ultrasonic sound transducer arrangement 300, according to an example. The first ultrasonic sound transducer arrangement 300 includes a loudspeaker 302 and four ultrasonic sound transducers, a near left ultrasonic sound transducer 310, a near right ultrasonic sound transducer 312, a far left ultrasonic sound transducer 314 and a far right ultrasonic sound transducer 316. The loudspeaker 302 is an example of an audio frequency sound transducer system. One or more of the depicted ultrasonic sound transducers is or are able to form an ultrasonic sound transducer component. The physical layout and arrangement to the first ultrasonic sound transducer arrangement 300 is able to represent the configuration of two different types of audio sound reproduction systems. A first type of audio sound reproduction system utilizes highly directive ultrasonic sound transducers and each of the four ultrasonic sound transducers are mounted or configured to emit ultrasonic sound in a different direction from the other ultrasonic sound transducers. For example, the near left ultrasonic sound transducer 310 is able to be directed at ten (10) degrees to the left of perpendicular (as viewed from the front as illustrated) from the face of the loudspeaker 302, the near right ultrasonic sound transducer 312 is able to be directed at ten (10) degrees to the right of perpendicular from the face of the loudspeaker 302, the far left ultrasonic sound transducer 314 is able to be directed at (30) degrees to the left of perpendicular from the face of the loudspeaker 302, and the far right ultrasonic sound transducer 316 is able to be directed at ten (30) degrees to the right of perpendicular from the face of the loudspeaker 302. In various examples, these ultrasonic sound transducers, additional ultrasonic sound transducers, or both, are able to be directed in any desired direction. In some examples, the one or more ultrasonic sound transducer is able to be directed with a direction component that is up or down relative to the horizontal axis of the front of the loudspeaker 302.

Configuring a particular ultrasonic sound direction in the first type of audio reproduction system is achieved by simply selecting an ultrasonic sound transducer from within the four ultrasonic sound transducers that emits ultrasonic sound in the desired ultrasonic direction. A modulated ultrasonic sound signal is then used to drive the selected ultrasonic sound transducer to cause modulated ultrasonic sound energy to propagate along the ultrasonic sound path associated with the selected ultrasonic sound transducer. In some examples, two or more ultrasonic sound transducers are able to be simultaneously driven in order to produce two or more respective narrow beamwidth modulated ultrasonic sound paths, such as the two narrow beamwidth modulated ultrasonic paths that are illustrated and described above with regards to FIG. 2.

In an alternative type of audio sound reproduction system depicted by the arrangement illustrated in FIG. 3, two or more of the four ultrasonic sound transducers are simultaneously driven with similar waveforms that have different phase relationships with each other in order to cause the four ultrasonic transducers to operate as a phased array of ultrasonic sound energy emitters. In general, the ultrasonic sound transducers in this type of audio sound reproduction equipment each have a broader beamwidth, such as beamwidths that include the entire range of ultrasonic sound directions that is able to be selected for an emitted ultrasonic sound path. The modulated ultrasonic sound signals driving the ultrasonic sound transducers in this example have phase values, amplitude values, or both, relative to each other that are selected so as to cause the ultrasonic sounds emitted by these ultrasonic transducers to constructively add along a selected ultrasonic direction. These ultrasonic sounds will not add as strongly at angles away from the selected ultrasonic direction and therefore will have reduced amplitude at other angles.

The first ultrasonic sound transducer arrangement 300 depicts the four ultrasonic transducers arranged in a horizontal row. When operating these transducers in a phased array arrangement, the selected ultrasonic direction is able to be varied in a horizontal direction relative to the loudspeaker 302. The spatial relationship among the four ultrasonic transducers, which has four emitters spaced over a relatively large horizontal dimension relative to the wavelength of the ultrasonic energy, is also able to more effectively reduce the resulting beamwidth of the emitted composite modulated ultrasonic sound energy.

In an example, the ultrasonic transducers form an ultrasonic sound transducer component that comprises a plurality of ultrasonic sound transducers disposed at respective locations relative to the audio frequency sound transducer system. An ultrasonic signal generator is further configured to generate, based on a modulated ultrasonic sound signal, a plurality of modulated ultrasonic sound signals, wherein each modulated ultrasonic sound signal within the plurality of modulated ultrasonic sound signals corresponds to a respective ultrasonic sound transducer within the plurality of ultrasonic sound transducers. The ultrasonic transducers are operated as a phased array by generating each respective modulated ultrasonic sound signal so as to have a phase and amplitude relationship with other respective modulated ultrasonic sound signals such that, based on a relationship among the location of each ultrasonic sound transducer relative to other ultrasonic sound transducers, emissions produced by the plurality of ultrasonic sound transducers based on the plurality of modulated ultrasonic sound signals constructively combine along the ultrasonic sound direction.

Figure 4:
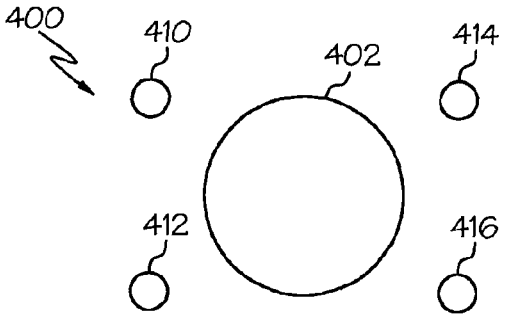
FIG. 4 illustrates a second ultrasonic sound transducer arrangement, according to an example.

FIG. 4 illustrates a second ultrasonic sound transducer arrangement 400, according to an example. The second ultrasonic sound transducer arrangement 400 includes a loudspeaker 402 and four ultrasonic sound transducers, a top left ultrasonic sound transducer 410, a bottom left ultrasonic sound transducer 412, a top right ultrasonic sound transducer 414 and a bottom right ultrasonic sound transducer 416. In a similar process as is discussed above with regards to the second type of audio sound reproduction system depicted by the first ultrasonic sound transducer arrangement 300 of FIG. 3, the four ultrasonic sound transducers of the second ultrasonic sound transducer arrangement 400 are simultaneously driven with similar waveforms that have different phase relationships with each other in order to cause the four ultrasonic transducers to operate as a phased array of ultrasonic sound energy emitters. As such, the ultrasonic sound transducers in this type of audio sound reproduction equipment each have a relatively broad beamwidth, such as a beamwidth that includes the entire range of ultrasonic sound directions that is able to be selected for an emitted ultrasonic sound path. The modulated ultrasonic sound signals driving the ultrasonic sound transducers in this example have phase values, amplitude values, or both, relative to each other that are selected so as to cause the ultrasonic sounds emitted by these ultrasonic transducers to constructively add along a selected ultrasonic direction.

The above description of multiple ultrasonic transducers included four transducers in order to simplify the description of relevant aspects of these examples. In further examples, many ultrasonic transducers are able to be mounted in proximity to an audio frequency speaker and operate in a manner similar to that described above.

Figure 5:
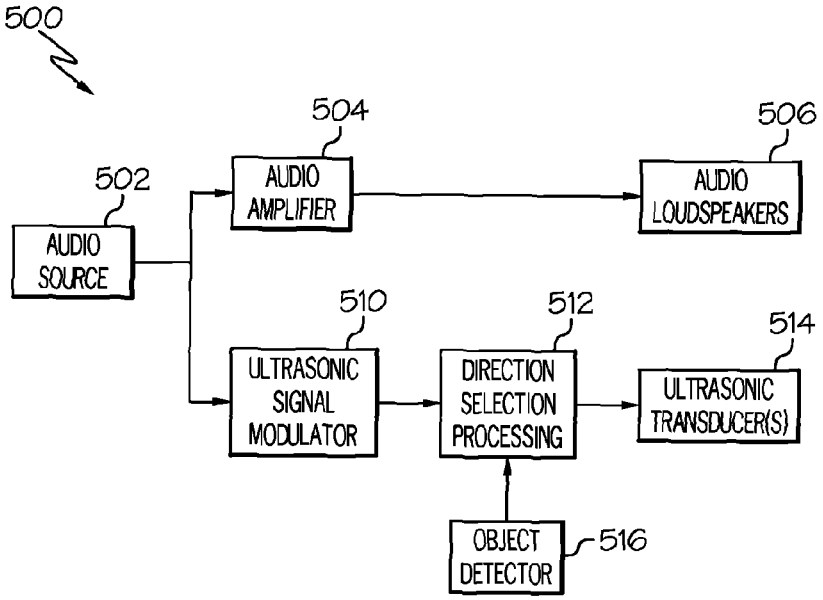
FIG. 5 illustrates an audio signal processing circuit, according to an example.

FIG. 5 illustrates an audio signal processing circuit 500, according to an example. The audio signal processing circuit 500 in one example is included in an audio sound reproduction system. The audio signal processing circuit 500 receives an audio signal via an audio source 502. The audio source 502 is able to include an interface to another component that produces an audio signal, is able to include storage or other sources of audio signals, or combinations of these. The audio signal received through the audio source 502 is provided in this example to an audio amplifier 504 for amplification and in some examples further processing to create an audio signal to be provided to audio loudspeakers 506. Audio loudspeakers 506 are examples of an audio frequency sound transducer system that emits an audio sound based on the created audio signal. In general, the audio loudspeakers 506 emit audio sound within a space defined by an audio beamwidth. The audio beamwidth is generally defined by the design of the audio loudspeakers 506 and usually has a fairly broad beamwidth over which the audio signal is emitted. The audio signal emitted by the audio loudspeakers 506 is able to emit audio sound over the audio beamwidth but the intensity of the sound is not necessarily uniform over the audio beamwidth. In various examples, the audio loudspeakers are able to include one physical speaker, or multiple speakers.

The audio signal received through the audio source 502 is also provided in this example to an ultrasonic signal modulator 510. The ultrasonic signal modulator 510 in one example generates a modulated ultrasonic sound signal that includes an ultrasonic carrier frequency and modulation sidebands. The ultrasonic signal modulator provides the generated modulated ultrasonic signal to a direction selection processing component 512. The direction selection processing component 512 in one example, performs processing to select an ultrasonic sound direction into which ultrasonic sound energy is to be emitted, as is described in further detail below.

The direction selection processing component 512 provides modulated ultrasonic sound signals to ultrasonic sound transducer(s) 514, which are an example of an ultrasonic sound transducer component. The ultrasonic sound transducer(s) 514 convert ultrasonic sound signals into ultrasonic sound energy that is emitted in a selected ultrasonic sound direction.

Various examples of audio signal processing circuits 500 are able to include different types of ultrasonic sound transducer(s) 514. In one example, the ultrasonic sound trans ducer(s) 514 are able to include a number of directional ultrasonic transducers that are each oriented or otherwise configured to emit ultrasonic sound energy in a respective ultrasonic sound direction with a relatively narrow beamwidth. Selection of a particular ultrasonic sound direction in such an example is performed by driving one of these several ultrasonic sound transducers with the ultrasonic sound signal corresponding to the ultrasonic sound energy to be emitted. In such an example, the direction selection processing operates to selectively route the modulated ultrasonic signal to the particular ultrasonic sound transducer that corresponds to the selected ultrasonic sound direction.

In another example, the ultrasonic sound transducer(s) 514 are able to include a number of ultrasonic sound transducers that are all driven with replicas of a modulated ultrasonic sound signal where each ultrasonic sound transducer is driven by a modulated ultrasonic sound signal that has a phase shift relative to the ultrasonic sound signal driving the other ultrasonic sound transducers. Driving each of a plurality of ultrasonic sound transducers with phase shifted replicas of the modulated ultrasonic signal causes the multiple ultrasonic sound transducers to operate as an electronically steerable phased array. Selection of the ultrasonic sound direction into which ultrasonic sound energy is emitted by the ultrasonic sound transducer(s) 514 is performed by modifying the phase relationships among the replicas of the ultrasonic sound signals driving each ultrasonic sound transducer. In one example, the direction selection processing component 512 receives a modulated ultrasonic sound signal as generated by the ultrasonic signal modulator 510, determines the phase shifts to be applied to each replica used to drive each ultrasonic sound transducer in order to cause ultrasonic sound energy to be emitted in the selected ultrasonic sound direction, creates replicas of the modulated ultrasonic sound signal with the determined phase shifts, and provides each replica to the proper ultrasonic sound transducer.

In the case of operating multiple ultrasonic sound transducers as a phased array, the direction selection processing component 512 of one example determines the phase shift to apply to each modulated ultrasonic sound signal based upon the selected ultrasonic sound direction into which ultrasonic sound energy is to be emitted, and also based upon a priori information concerning the location of each ultrasonic sound transducer relative to the other ultrasonic sound transducers. Processing to determine these phase shift values based upon transducer location and selected emission angle are known to practitioners of ordinary skill in the relevant arts.

The ultrasonic signal modulator 510 in one example operates to create modulated ultrasonic sound signals that will create audible sounds heard by a listener of the ultrasonic sound energy emitted by the ultrasonic sound transducer(s) 514. The ultrasonic signal modulator 510 creates modulated ultrasonic sound signals that cause the ultrasonic transducer(s) to emit modulated ultrasonic sound energy that creates audible sounds such that the created audible sounds are 180 degrees out-of-phase with the audio signal emitted by the audio loudspeakers 506. The ultrasonic signal modulator 510 further creates the modulated ultrasonic sound signal to create audible sounds that have an amplitude, such as is measured by sound pressure, at a conventional listening point for the audio loudspeakers 506 that is equal to the audio sound emitted by the audio loudspeakers 506. Because the ultrasonic signal modulator creates a modulated ultrasonic sound signal that causes the ultrasonic sound transducer(s) 514 to emit modulated ultrasonic sound energy with the above characteristics, the modulated ultrasonic sound energy performs audio sound cancellation along the path of the emitted modulated ultrasonic sound energy that combines with and cancels the audio sound emitted by the audio loudspeakers 506.

In some examples, the audio loudspeakers 506 and the ultrasonic sound transducer(s) 514 have a physical arrangement similar to those described above with regards to the first ultrasonic sound transducer arrangement 300 or the second ultrasonic sound transducer arrangement 400. In general, the audio loudspeakers 506 and the ultrasonic sound transducer(s) 514 are able to have any physical arrangement. In examples that are similar to the above described ultrasonic sound transducer arrangements where the ultrasonic sound transducers are located near the audio sound transducer, an audible cancellation sound that combines with and cancels the audio sound emitted by the audio loudspeakers 506 is able to be emitted by the ultrasonic sound transducer(s) 514 if the audio cancellation sound has an amplitude substantially equal to the amplitude of the audio sound emitted by the audio loudspeakers 506 and is 180 degrees out of phase with the audio sound emitted by the audio loudspeakers 506. Such a fixed relationship between the audio signal emitted by the audio loudspeakers 506 and the sound cancellation sound emitted by the ultrasonic sound transducer(s) 514 greatly reduces the processing and monitoring required to determine the parameters of a proper sound cancellation waveform. In one example, the ultrasonic signal modulator is an ultrasonic signal generator configured to generate a modulated ultrasonic sound signal such that the modulated ultrasonic sound energy emitted by the ultrasonic sound transducer(s) 514 is substantially out of phase, along the ultrasonic sound direction, with the audio sound emitted by the audio loudspeakers 506, and the modulated ultrasonic sound energy creates an audible cancellation signal with an amplitude substantially equal to an amplitude of the audio signal at a point within the ultrasonic beamwidth that combines with and cancels the audio sound at the point.

The illustrated audio signal processing circuit 500 includes and object detector 516 that detects a presence of an object in the audio beamwidth of the audio loudspeakers 506, and produces an indication of respective locations of those objects. The object detector 516 is able to determine distance and angle to one or more objects in the area covering the audio loudspeakers 506 by using any suitable technique, such as ultrasonic, radio, optical, or other detection and ranging techniques. In alternative examples, an object detector 516 is not included. Some examples that do not include an object detector direct the modulated ultrasonic sound energy into directions defined by, for example, the physical characteristics of a device including the audio signal processing circuit 500 and the expected locations of various persons relative to that device when it is in operation.

The object detector 516 in one example operates to determine a distance and angle to objects relative to the audio loudspeakers and provides an indication of the detected location to the direction selection processing component 512. In one example, the indication of the detected location of the object is used to determine the distance between the object and the audio loudspeakers 506 and also the angle at which ultrasonic sound energy is to be directed from the ultrasonic sound transducer(s) 514 in order to reach the object.

In the illustrated example, an audible cancellation sound is emitted by the ultrasonic sound transducer(s) 514 in the form of modulated ultrasonic sound energy that operates to create human audible sounds at a listener's position. The direction selection processing component 512 in one example determines the ultrasonic sound direction, which is the physical angle at which the ultrasonic sound energy is to be emitted by the ultrasonic sound transducer(s) 514. The direction selection processing component 512 in one example determines the ultrasonic sound direction based on detected location of the object, and bases the amplitude of the ultrasonic sound energy based on the determined location of at least one of the detected objects. The ultrasonic sound transducer(s) 514 emit energy at this determined angle in order to reach the detected object, such as the listener for whom the audio signal is to be cancelled. In one example, objects to which an audio cancellation signal is to be directed are determined to be objects that are not directly in front of a particular component of a system for which audio is being emitted, such as a visual display and that are objects with a size that corresponds to the size of a person.

The audio sound in one example is emitted by the audio loudspeakers 506 and the ultrasonic sound transducer(s) 514 emit an audible cancellation sound in the direction of one or more detected objects, e.g., listener(s). In one example, the audio loudspeakers 506 and ultrasonic sound transducer(s) 514 are located in close proximity to each other so that the emitted audible cancellation sound and emitted audio signal travel substantially equal distances to the listener. This causes an insubstantial amount of phase shift between these two sounds due to different distances of travel between their emitters and the listener. In this configuration, it can be assumed that there is not an appreciable phase shift between the emitted modulated ultrasonic sound energy emitted and the emitted audio signals when these two signals reach the detected object. The lack of an appreciable phase shift between these two signals allows an effected audio cancelation signal to be created that is a replica of the audio signal but with a 180 degree phase shift.

In order to combine with and cancel the audio signal, the audible cancellation signal is created so as to have substantially similar amplitude with a substantially 180 degree phase shift at the point of the listener. If the amplitude of the audible cancellation sound is greater than the audio sound, the audible cancellation sound will itself be heard and not effectively cancel the audio signal. The attenuation of ultrasonic sound energy propagating through the air is greater than the attenuation of human audible signals. In order to compensate for this greater attenuation, the amplitude of the emitted modulated ultrasonic energy conveying the audible cancellation sound amplitude is able to be increased relative to the amplitude of the emitted audio sound in order to better match the two sounds so that the audible cancellation sound reaches the object with an amplitude that is closer to the audio signal reaching the same object. Such an amplitude correction of the emitted modulated ultrasonic sound energy is able to be based on the distance between the ultrasonic sound transducer(s) 514 and the detected object, as is detected by the object detector 516.

Figure 6:
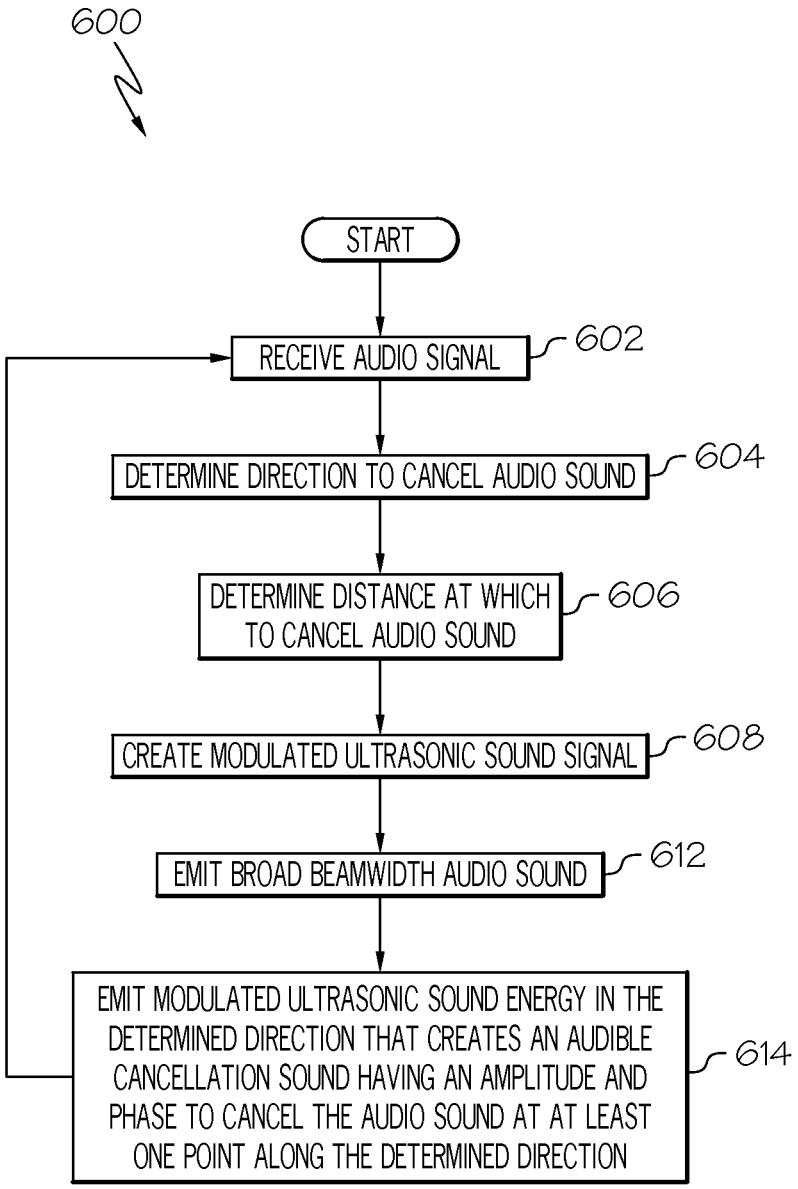
FIG. 6 illustrates an audio sound reproduction process, according to one example.

FIG. 6 illustrates an audio sound reproduction process 600, according to one example. The audio sound reproduction process 600 in one example is performed by the audio signal processing circuit 500 to perform the above described operations or within the electronic device 700 as described below with regards to FIG. 7. The following description references elements of the audio signal processing circuit 500 to illustrate non-limiting examples of performing the below described steps.

The audio sound reproduction process 600 begins by receiving, at 602, an audio signal. Examples of receiving audio signals are described above with regards to the audio source 502 of FIG. 5. A direction in which to cancel an emitted audio signal is determined, at 604. A distance at which to cancel emitted audio signals is determined, at 606. The direction of and distance to an object at which audio sound is to be cancelled is able to be determined by any suitable technique, such as by configuration parameters defined by the anticipated use of a device or user preferences, by design parameters of a device, by measurements performed by components of the device, by other determination techniques, or by combinations of two or more of these. Examples of determining direction and distance to an object, and the effects of those quantities on other aspects of processing, is described above with regards to the object detector 516 of FIG. 5.

The audio sound reproduction process 600 continues by creating, at 608, a modulated ultrasonic sound signal. In this example, the modulated ultrasonic sound signal is created based upon the determined direction and distance to the object as determined above. The aspects of creating various types of ultrasonic sound signals is described above with regards to the ultrasonic signal modulator 510 of FIG. 5.

The audio sound reproduction process 600 continues emitting, at 612, a broad beamwidth audio signal, such as by the audio speakers 506 discussed above. The audio sound reproduction process 600 further emits modulated ultrasonic sound energy in the determined direction and with an amplitude to cancel the audio signal at the determined distance. Examples of processing to emit the broad beamwidth audio signal and modulated ultrasonic sound energy are described above with regards to the audio signal processing circuit 500 of FIG. 5. The audio sound reproduction process 600 then returns to receiving an audio signal.

Figure 7:
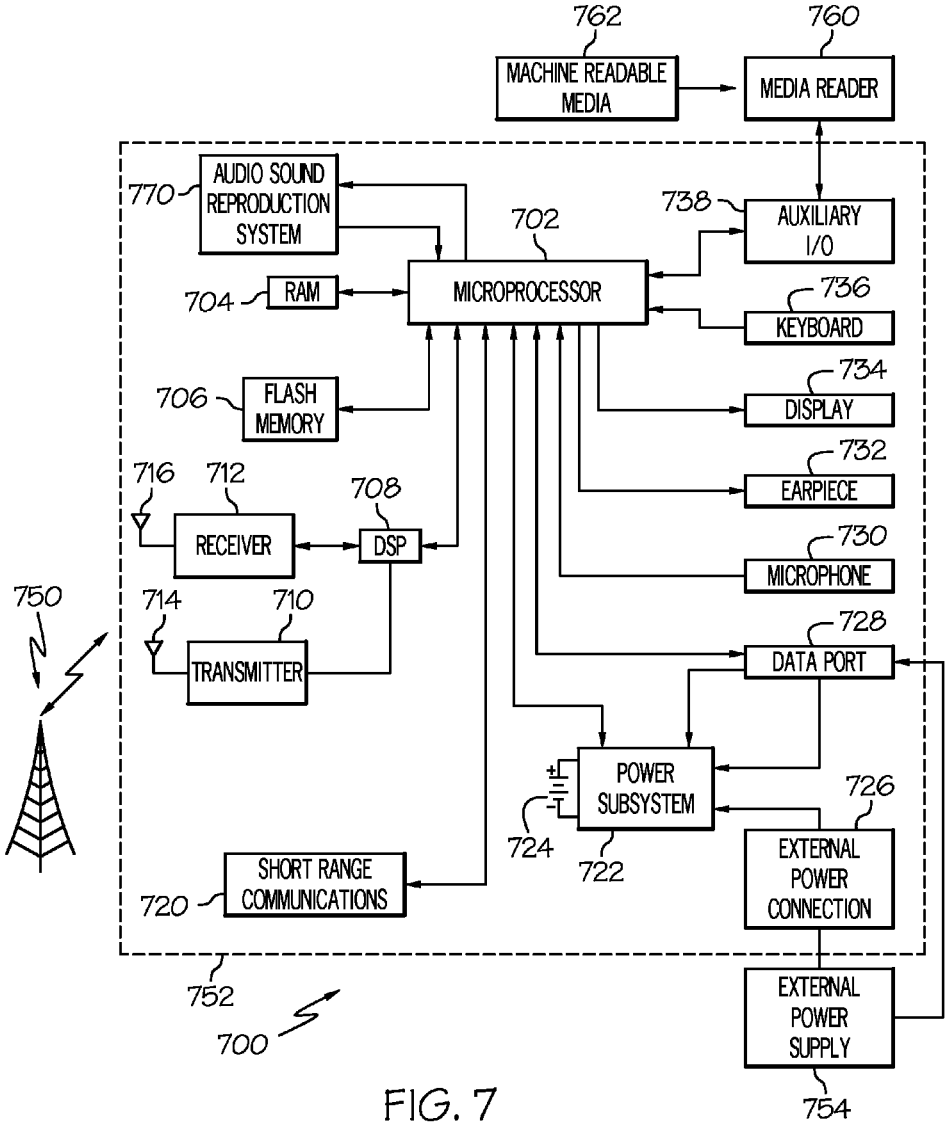
FIG. 7 is a block diagram of an electronic device and associated components in which the systems and methods disclosed herein may be implemented.

FIG. 7 is a block diagram of an electronic device and associated components 700 in which the systems and methods disclosed herein may be implemented. In this example, an electronic device 752 is also a wireless two-way communication device with voice and data communication capabilities. Such electronic devices communicate with a wireless voice or data network 750 using a suitable wireless communications protocol. Wireless voice communications are performed using either an analog or digital wireless communication channel. Data communications allow the electronic device 752 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities.

The illustrated electronic device 752 is an example electronic device that includes two-way wireless communications functions. Such electronic devices incorporate communication subsystem elements such as a wireless transmitter 710, a wireless receiver 712, and associated components such as one or more antenna elements 714 and 716. A digital signal processor (DSP) 708 performs processing to extract data from received wireless signals and to generate signals to be transmitted. The particular design of the communication subsystem is dependent upon the communication network and associated wireless communications protocols with which the device is intended to operate.

The electronic device 752 includes a microprocessor 702 that controls the overall operation of the electronic device 752. The microprocessor 702 interacts with the above described communications subsystem elements and also interacts with other device subsystems such as flash memory 706, random access memory (RAM) 704, auxiliary input/output (I/O) device 738, data port 728, display 734, keyboard 736, earpiece 732, audio sound reproduction system 770, microphone 730, a short-range communications subsystem 720, a power subsystem 722, other subsystems, or combinations of these.

One or more power storage or supply elements, such as a battery 724, are connected to a power subsystem 722 to provide power to the circuits of the electronic device 752. The power subsystem 722 includes power distribution circuitry for providing power to the electronic device 752 and also contains battery charging circuitry to manage recharging the battery 724 (or circuitry to replenish power to another power storage element). The power subsystem 722 receives electrical power from external power supply 754. The power subsystem 722 is able to be connected to the external power supply 754 through a dedicated external power connector (not shown) or through power connections within the data port 728. The power subsystem 722 includes a battery monitoring circuit that is operable to provide a status of one or more battery status indicators, such as remaining capacity, temperature, voltage, electrical current consumption, and the like, to various components of the electronic device 752.

The data port 728 is able to support data communications between the electronic device 752 and other devices through various modes of data communications, such as high speed data transfers over an optical communications circuits. Data port 728 is able to support communications with, for example, an external computer or other device. In some examples, the data port 728 is able to include electrical power connections to provide externally provided electrical power to the electronic device 752, deliver electrical power from the electronic device 752 to other externally connected devices, or both. Data port 728 of, for example, an electronic accessory is able to provide power to an electronic circuit, such as microprocessor 702, and support exchanging data between the microprocessor 702 and a remote electronic device that is connected through the data port 728.

Data communication through data port 728 enables a user to set preferences through the external device or through a software application and extends the capabilities of the device by enabling information or software exchange through direct connections between the electronic device 752 and external data sources rather than via a wireless data communication network. In addition to data communication, the data port 728 provides power to the power subsystem 722 to charge the battery 724 or to supply power to the electronic circuits, such as microprocessor 702, of the electronic device 752.

Operating system software used by the microprocessor 702 is stored in flash memory 706. Further examples are able to use a battery backed-up RAM or other non-volatile storage data elements to store operating systems, other executable programs, or both. The operating system software, device application software, or parts thereof, are able to be temporarily loaded into volatile data storage such as RAM 704. Data received via wireless communication signals or through wired communications are also able to be stored to RAM 704.

The microprocessor 702, in addition to its operating system functions, is able to execute software applications on the electronic device 752. A set of applications that control basic device operations, including at least data and voice communication applications, is able to be installed on the electronic device 752 during manufacture. Examples of applications that are able to be loaded onto the device may be a personal information manager (PIM) application having the ability to organize and manage data items relating to the device user, such as, but not limited to, e-mail, calendar events, voice mails, appointments, and task items.

Further applications may also be loaded onto the electronic device 752 through, for example, the wireless network 750, an auxiliary I/O device 738, Data port 728, short-range communications subsystem 720, or any combination of these interfaces. Such applications are then able to be installed by a user in the RAM 704 or a non-volatile store for execution by the microprocessor 702.

In a data communication mode, a received signal such as a text message or web page download is processed by the communication subsystem, including wireless receiver 712 and wireless transmitter 710, and communicated data is provided the microprocessor 702, which is able to further process the received data for output to the display 734, or alternatively, to an auxiliary I/O device 738 or the Data port 728. A user of the electronic device 752 may also compose data items, such as e-mail messages, using the keyboard 736, which is able to include a complete alphanumeric keyboard or a telephone-type keypad, in conjunction with the display 734 and possibly an auxiliary I/O device 738. Such composed items are then able to be transmitted over a communication network through the communication subsystem.

For voice communications, overall operation of the electronic device 752 is substantially similar, except that received signals are generally provided to an earpiece 732 and signals for transmission are generally produced by a microphone 730. Alternative voice or audio I/O subsystems, such as a voice message recording subsystem, may also be implemented on the electronic device 752. Although voice or audio signal output is generally accomplished primarily through the earpiece 732, the display 734 may also be used to provide an indication of the identity of a calling party, the duration of a voice call, or other voice call related information, for example.

The audio sound reproduction system 770 is an example of the audio signal processing circuit 500 described above. As described in regards to the above described examples, the audio sound reproduction system 770 includes an audio loudspeaker and one or more ultrasonic sound transducers. The audio sound reproduction system 770 in one example operates to emit audio sound within an audio beamwidth, that is generally a broad beamwidth, and to also emit, within a narrow beamwidth within the broad beamwidth, a modulated ultrasonic sound conveying an audible cancellation sound that operates to combine with and cancel the emitted audio sound within that narrow beamwidth.

Depending on conditions or statuses of the electronic device 752, one or more particular functions associated with a subsystem circuit may be disabled, or an entire subsystem circuit may be disabled. For example, if the battery temperature is low, then voice functions may be disabled, but data communications, such as e-mail, may still be enabled over the communication subsystem.

A short-range communications subsystem 720 provides for data communication between the electronic device 752 and different systems or devices, which need not necessarily be similar devices. For example, the short-range communications subsystem 720 includes an infrared device and associated circuits and components or a Radio Frequency based communication module such as one supporting Bluetooth® communications, to provide for communication with similarly-enabled systems and devices, including the data file transfer communications described above.

A media reader 760 is able to be connected to an auxiliary I/O device 738 to allow, for example, loading computer readable program code of a computer program product into the electronic device 752 for storage into flash memory 706. One example of a media reader 760 is an optical drive such as a CD/DVD drive, which may be used to store data to and read data from a computer readable medium or storage product such as computer readable storage media 762. Examples of suitable computer readable storage media include optical storage media such as a CD or DVD, magnetic media, or any other suitable data storage device. Media reader 760 is alternatively able to be connected to the electronic device through the Data port 728 or computer readable program code is alternatively able to be provided to the electronic device 752 through the wireless network 750.

The above described examples include various aspects. Below are listed some examples of these aspects, including examples of these aspects identified by reference numerals as are discussed above are listed are described below.

A) An audio sound reproduction system (500), comprising:

an audio frequency sound transducer system (506) configured to emit an audio sound (612) within a space comprising an audio beamwidth (210), wherein the audio sound is based on an audio signal;

an ultrasonic sound transducer component (514) configured to emit modulated ultrasonic sound energy (614) in an ultrasonic sound direction within an ultrasonic beamwidth (220, 222) that is less than and within the audio beamwidth, wherein the modulated ultrasonic sound energy is based on a modulated ultrasonic sound signal; and an ultrasonic signal generator (510) configured to generate the modulated ultrasonic sound signal, the ultrasonic signal generator configured to generate the modulated ultrasonic sound signal such that the modulated ultrasonic sound energy emitted by the ultrasonic sound transducer creates an audible cancellation sound (220, 222) with an amplitude substantially equal to an amplitude of the audio sound at a point within the ultrasonic beamwidth so as to combine with and cancel the audio sound at the point by being substantially out of phase with the audio sound along the ultrasonic sound direction.

B) The audio sound reproduction system of A, wherein the audio frequency sound transducer system comprises at least one audio frequency speaker (110), and wherein the ultrasonic sound transducer component comprises at least one ultrasonic sound transducer (112, 114, 116, 118).

C) The audio sound reproduction system of at least one of examples A and B, further comprising an object detector (516) configured to:

detect a presence of one or more objects within the audio beamwidth (604, 606); and produce an indication of a respective location of at least one of the one or more objects, and wherein the ultrasonic signal generator is communicatively coupled to the object detector, and the ultrasonic signal generator is further configured to determine the ultrasonic sound direction based upon the respective location, and wherein respective amplitudes of the audible cancellation sound is based upon a distance to the at least one of the one or more objects (608).

D) The audio sound reproduction system of at least one of examples A-C, wherein the ultrasonic sound transducer component comprises at least one directional ultrasonic sound transducer (112, 114, 116, 118) component configured to emit ultrasonic sound in the ultrasonic sound direction.

E) The audio sound reproduction system of at least one of examples A-D, wherein the ultrasonic sound transducer component comprises a plurality of ultrasonic sound transducers disposed at respective locations relative to the audio frequency sound transducer system (112, 114, 116, 118), and wherein the ultrasonic signal generator is further configured to generate, based on the modulated ultrasonic sound signal, a plurality of modulated ultrasonic sound signals, wherein each modulated ultrasonic sound signal within the plurality of modulated ultrasonic sound signals corresponds to a respective ultrasonic sound transducer within the plurality of ultrasonic sound transducers, wherein each respective modulated ultrasonic sound signal has a phase and amplitude relationship with other respective modulated ultrasonic sound signals such that, based on a relationship among the location of each ultrasonic sound transducer relative to other ultrasonic sound transducers, emissions produced by the plurality of ultrasonic sound transducers based on the plurality of modulated ultrasonic sound signals constructively combine along the ultrasonic sound direction.

F) A method of reproducing audio sound, which method can operate with any one of examples A-E, the method comprising:

emitting, with an audio frequency sound transducer system (506), an audio sound within a space comprising an audio beamwidth (210), wherein the audio sound is based on an audio signal (612);

emitting, by an ultrasonic sound transducer component (514), modulated ultrasonic sound energy in an ultrasonic sound direction within an ultrasonic beamwidth that is less than and within the audio beamwidth (220, 222), wherein the modulated ultrasonic sound energy is based on a modulated ultrasonic sound signal (614); and generating the modulated ultrasonic sound signal such that the modulated ultrasonic sound energy creates an audible cancellation sound (220, 222) with an amplitude substantially equal to an amplitude of the audio sound at a point within the ultrasonic beamwidth so as to combine with and cancel the audio sound at the point by being substantially out of phase with the audio sound along the ultrasonic sound direction.

G) The method of F, wherein the emitting the audio sound comprises emitting the audio sound with at least one audio frequency speaker (110), and wherein the emitting modulated ultrasonic sound energy comprises emitting the modulated ultrasonic sound energy with at least one ultrasonic sound transducer (112, 114, 116, 118).

H) The method of at least one of examples F and G, further comprising:

detecting a presence of one or more objects within the audio beamwidth (604, 606); and producing an indication of a respective location of at least one of the one or more objects, and determining the ultrasonic sound direction based upon the respective location, and wherein respective amplitudes of the audible cancellation sound are based upon a distance to the at least one of the one or more objects (608).

I) The method of at least one of examples F-H, wherein the emitting modulated ultrasonic sound energy comprises emitting the modulated ultrasonic sound energy with at least one directional ultrasonic sound transducer (112, 114, 116, 118) configured to emit ultrasonic sound in the ultrasonic sound direction.

J) The method of at least one of examples F-I, wherein the emitting modulated ultrasonic sound energy comprises emitting the modulated ultrasonic sound energy with a plurality of ultrasonic sound transducers disposed at respective locations relative to the audio frequency sound transducer system (112, 114, 116, 118), the method further comprising:

generating, based on the modulated ultrasonic sound signal, a plurality of modulated ultrasonic sound signals, wherein each modulated ultrasonic sound signal within the plurality of modulated ultrasonic sound signals corresponds to a respective ultrasonic sound transducer within the plurality of ultrasonic sound transducers, wherein each respective modulated ultrasonic sound signal has a phase and amplitude relationship with other respective modulated ultrasonic sound signals such that, based on a relationship among the location of each ultrasonic sound transducer relative to other ultrasonic sound transducers, emissions produced by the plurality of ultrasonic sound transducers based on the plurality of modulated ultrasonic sound signals constructively combine along the ultrasonic sound direction.

K) A computer program for instructing a computer to perform the method of any one of F, G, H, I, or J.

L) A mobile phone to perform the method of any one of F, G, H, I, or J and/or including the systems of examples A-E.

Information Processing System

The present subject matter can be realized in hardware, software, or a combination of hardware and software. A system can be realized in a centralized fashion in one computer system, or in a distributed fashion where different elements are spread across several interconnected computer systems. Any kind of computer system—or other apparatus adapted for carrying out the methods described herein—is suitable. A typical combination of hardware and software could be a general purpose computer system with a computer program that, when being loaded and executed, controls the computer system such that it carries out the methods described herein.

The present subject matter can also be embedded in a computer program product, which comprises all the features enabling the implementation of the methods described herein, and which—when loaded in a computer system—is able to carry out these methods. Computer program in the present context means any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include computer readable storage medium embodying non-volatile memory, such as read-only memory (ROM), flash memory, disk drive memory, CD-ROM, and other permanent storage. Additionally, a computer medium may include volatile storage such as RAM, buffers, cache memory, and network circuits. Furthermore, the computer readable medium may comprise computer readable information in a transitory state medium such as a network link and/or a network interface, including a wired network or a wireless network, that allow a computer to read such computer readable information.

Non-Limiting Examples

Although specific embodiments of the subject matter have been disclosed, those having ordinary skill in the art will understand that changes can be made to the specific embodiments without departing from the spirit and scope of the disclosed subject matter. The scope of the disclosure is not to be restricted, therefore, to the specific embodiments, and it is intended that the appended claims cover any and all such applications, modifications, and embodiments within the scope of the present disclosure.

What is claimed is:

1. An audio sound reproduction system, comprising:

an audio frequency sound transducer system configured to emit an audio sound within a space comprising an audio beamwidth, wherein the audio sound is based on an audio signal;

an ultrasonic sound transducer component configured to emit modulated ultrasonic sound energy in at least one ultrasonic sound direction, each ultrasonic sound direction having a respective ultrasonic beamwidth that is less than and within the audio beamwidth, wherein the modulated ultrasonic sound energy is based on a modulated ultrasonic sound signal;

an object detector configured to:

determine a respective object location for at least one object within the audio beamwidth, the respective object locations being independent of the ultrasonic beamwidth; and produce a respective indication of the respective object location for the at least one object; and an ultrasonic signal generator, coupled to the object detector, configured to generate the modulated ultrasonic sound signal, the ultrasonic signal generator configured to generate, based on the respective indication, the modulated ultrasonic sound signal such that the modulated ultrasonic sound energy emitted by the ultrasonic sound transducer creates an audible cancellation sound with an amplitude substantially equal to an amplitude of the audio sound at the respective object location so as to combine with and cancel the audio sound at the respective object location by being substantially out of phase with the audio sound along each ultrasonic sound direction.

2. The audio sound reproduction system of claim 1, wherein the audio frequency sound transducer system comprises at least one audio frequency speaker, and wherein the ultrasonic sound transducer component comprises at least one ultrasonic sound transducer.

3. The audio sound reproduction system of claim 1, wherein the ultrasonic sound transducer component comprises at least one directional ultrasonic sound transducer component configured to emit ultrasonic sound in the at least one ultrasonic sound direction.

4. The audio sound reproduction system of claim 3, wherein the ultrasonic sound transducer component comprises a plurality of ultrasonic sound transducers disposed at respective locations relative to the audio frequency sound transducer system, and wherein the ultrasonic signal generator is further configured to:

determine the at least one ultrasonic sound direction based on the respective indication of the respective object location, and generate, based on the modulated ultrasonic sound signal, a plurality of modulated ultrasonic sound signals, wherein each modulated ultrasonic sound signal within the plurality of modulated ultrasonic sound signals corresponds to a respective ultrasonic sound transducer within the plurality of ultrasonic sound transducers, wherein each respective modulated ultrasonic sound signal has a phase and amplitude relationship with other respective modulated ultrasonic sound signals such that, based on a relationship among the location of each ultrasonic sound transducer relative to other ultrasonic sound transducers, emissions produced by the plurality of ultrasonic sound transducers based on the plurality of modulated ultrasonic sound signals constructively combine along each ultrasonic sound direction to create the audible cancellation sound.

5. The audio sound reproduction system of claim 1, wherein the respective indication of the respective object location comprises a distance to the respective object and a direction of the respective object relative to the ultrasonic sound transducer component.

6. The audio sound reproduction system of claim 4, wherein the object detector is further configured to:

detect a presence of a plurality of objects within the audio beamwidth;

determine a respective location to each object in the plurality of objects; and determine a plurality of directions comprising a respective direction to each respective location, and wherein the ultrasonic signal generator is further configured to generate the plurality of modulated ultrasonic sound signals such that, based on a relationship among the location of each ultrasonic sound transducer relative to other ultrasonic sound transducers, emissions produced by the plurality of ultrasonic sound transducers based on the plurality of modulated ultrasonic sound signals constructively combine along the plurality of directions to create an audible cancellation sound with an amplitude substantially equal to an amplitude of the audio sound at each respective object location that is substantially out of phase with the audio signal at each respective object location.

7. The audio sound reproduction system of claim 1, wherein the ultrasonic sound transducer component comprises a plurality of ultrasonic sound transducers disposed at respective locations relative to the audio frequency sound transducer system, wherein respective ultrasonic sound transducers within the plurality of ultrasonic sound transducers are configured to emit sound in a respective direction different from a direction of emission of other ultrasonic sound transducers within the plurality of ultrasonic sound transducers, and wherein the ultrasonic signal generator is further configured to:

determine the at least one ultrasonic sound direction based on the respective indication of the respective object location;

select, based on the at least one ultrasonic sound direction, a respective selected ultrasonic sound transducer that emits ultrasonic sound in a respective direction corresponding to each of the at least one ultrasonic sound direction; and use the respective selected ultrasonic sound transducer to emit modulated ultrasonic sound energy to combine with and cancel the audio sound at the respective object location.

8. A method of reproducing audio sound, the method comprising:

emitting, with an audio frequency sound transducer system, an audio sound within a space comprising an audio beamwidth, wherein the audio sound is based on an audio signal;

emitting modulated ultrasonic sound energy in at least one ultrasonic sound direction, each ultrasonic sound direction having a respective ultrasonic beamwidth that is less than and within the audio beamwidth, wherein the modulated ultrasonic sound energy is based on a modulated ultrasonic sound signal;

determining a respective object location for at least one object within the audio beamwidth, the respective object locations being independent of the ultrasonic beamwidth;

producing a respective indication of the respective object location for the at least one object; and generating, based on the respective indication, the modulated ultrasonic sound signal such that an emitted modulated ultrasonic sound energy creates an audible cancellation sound with an amplitude substantially equal to an amplitude of the audio sound at the respective object location so as to combine with and cancel the audio sound at the respective object location by being substantially out of phase with the audio sound along each ultrasonic sound direction.

9. The method of claim 8, wherein the emitting the audio sound comprises emitting the audio sound with at least one audio frequency speaker, and wherein the emitting modulated ultrasonic sound energy comprises emitting the modulated ultrasonic sound energy with at least one ultrasonic sound transducer.

10. The method of claim 8, wherein the emitting modulated ultrasonic sound energy comprises emitting the modulated ultrasonic sound energy with at least one directional ultrasonic sound transducer configured to emit ultrasonic sound in the at least one ultrasonic sound direction.

11. The method of claim 10, wherein the emitting modulated ultrasonic sound energy comprises emitting the modulated ultrasonic sound energy with a plurality of ultrasonic sound transducers disposed at respective locations relative to the audio frequency sound transducer system, the method further comprising:

determining the at least one ultrasonic sound direction based on the respective indication of the respective object location, and generating, based on the modulated ultrasonic sound signal, a plurality of modulated ultrasonic sound signals, wherein each modulated ultrasonic sound signal within the plurality of modulated ultrasonic sound signals corresponds to a respective ultrasonic sound transducer within the plurality of ultrasonic sound transducers, wherein each respective modulated ultrasonic sound signal has a phase and amplitude relationship with other respective modulated ultrasonic sound signals such that, based on a relationship among the location of each ultrasonic sound transducer relative to other ultrasonic sound transducers, emissions produced by the plurality of ultrasonic sound transducers based on the plurality of modulated ultrasonic sound signals constructively combine along each ultrasonic sound direction to create the audible cancellation sound.

12. A non-transitory computer readable storage medium having computer readable program code embodied therewith, the computer readable program code comprising instructions for:

emitting, with an audio frequency sound transducer system, an audio sound within a space comprising an audio beamwidth, wherein the audio sound is based on an audio signal;

emitting modulated ultrasonic sound energy in at least one ultrasonic sound direction, each ultrasonic sound direction having a respective ultrasonic beamwidth that is less than and within the audio beamwidth, wherein the modulated ultrasonic sound energy is based on a modulated ultrasonic sound signal;

determining a respective object location for at least one object within the audio beamwidth, the respective object locations being independent of the ultrasonic beamwidth;

producing a respective indication of the respective object location for the at least one object; and generating, based on the respective indication, the modulated ultrasonic sound signal such that an emitted modulated ultrasonic sound energy creates an audible cancellation sound with an amplitude substantially equal to an amplitude of the audio sound at the respective object location so as to combine with and cancel the audio sound at the respective object location by being substantially out of phase with the audio sound along each ultrasonic sound direction.

13. The non-transitory computer readable storage medium of claim 12, wherein the instructions for emitting the audio sound comprise instructions for emitting the audio sound with at least one audio frequency speaker, and wherein the instructions for emitting modulated ultrasonic sound energy comprise instructions for emitting the modulated ultrasonic sound energy with at least one ultrasonic sound transducer.

14. The non-transitory computer readable storage medium of claim 12, wherein the instructions for emitting modulated ultrasonic sound energy comprise instructions for emitting the modulated ultrasonic sound energy with at least one directional ultrasonic sound transducer configured to emit ultrasonic sound in the at least one ultrasonic sound direction.

15. The non-transitory computer readable storage medium of claim 14, wherein the instructions for emitting modulated ultrasonic sound energy comprise instructions for emitting the modulated ultrasonic sound energy with a plurality of ultrasonic sound transducers disposed at respective locations relative to the audio frequency sound transducer system, the computer readable storage medium further comprising instructions for:

determining the at least one ultrasonic sound direction based on the respective indication of the respective object location, and generating, based on the modulated ultrasonic sound signal, a plurality of modulated ultrasonic sound signals, wherein each modulated ultrasonic sound signal within the plurality of modulated ultrasonic sound signals corresponds to a respective ultrasonic sound transducer within the plurality of ultrasonic sound transducers, wherein each respective modulated ultrasonic sound signal has a phase and amplitude relationship with other respective modulated ultrasonic sound signals such that, based on a relationship among the location of each ultrasonic sound transducer relative to other ultrasonic sound transducers, emissions produced by the plurality of ultrasonic sound transducers are based on the plurality of modulated ultrasonic sound signals constructively combine along each ultrasonic sound direction to create the audible cancellation sound.

* * * * *